United States Patent [19]

Livingston et al.

[11] 4,079,573

[45] Mar. 21, 1978

[54] CASE SEALER APPARATUS

[75] Inventors: Ralph H. Livingston, Excelsior; Philip G. Rawlins, Minneapolis, both of Minn.

[73] Assignee: Bemis Company, Inc., Minneapolis, Minn.

[21] Appl. No.: 776,651

[22] Filed: Mar. 11, 1977

[51] Int. Cl.[2] ..... B65B 57/00; B65B 7/20

[52] U.S. Cl. ..... 53/77; 53/374; 198/856

[58] Field of Search ..... 53/77, 75, 374; 198/719, 856

[56] References Cited

U.S. PATENT DOCUMENTS

| | | | |
|---|---|---|---|
| 3,496,697 | 2/1970 | Loveland et al. | 53/374 X |
| 3,680,685 | 8/1972 | Halton | 198/856 |

*Primary Examiner*—Travis S. McGehee

*Attorney, Agent, or Firm*—Dugger, Johnson & Westman

[57] ABSTRACT

Case sealer apparatus for sealing filled cases that have their top flaps extending vertically and that includes flight bars on endless chains for first moving the filled case over frusto conical rolls to slightly open the bottom major flaps and permit the package plate to enter between the major and minor bottom flaps. A guide plate and a flap tucker assembly are provided above the package plate to close the leading and trailing top minor flaps respectively as the case moves forwardly. Glue guns then apply adhesive to the upper minor and lower major flaps. Thereafter as the case moves along the slide plate, the major flaps move into contact with closure members to close the major flaps, and then the flight bars move the case through a compression roller assembly. The package plate includes a hingedly mounted entry portion that is resiliently retained in an entry position while the drive mechanism for the chains includes adjustable stop mechanism to discontinue the chain drive to provide overload protection. An indexing assembly is provided to control the infeed of cases in timed relationship with the movement of the flight bars.

18 Claims, 12 Drawing Figures

9
9
8
8
7
7
10
22
23
25
26
28
31
33
38
38
42
44
45
46
47
48
50
51
52
54
54a
54d
55
56
59
60
61
62
63
64
65
66
69
74
75
80
117
125
160
165a
170
171
172
176
177
178
184
185
186
186a
186b
186c
187
188
190
191
192
222
223
223a
225
226
226a
226b
231
232
233
235
236
239
240
241
242

FIG. 2
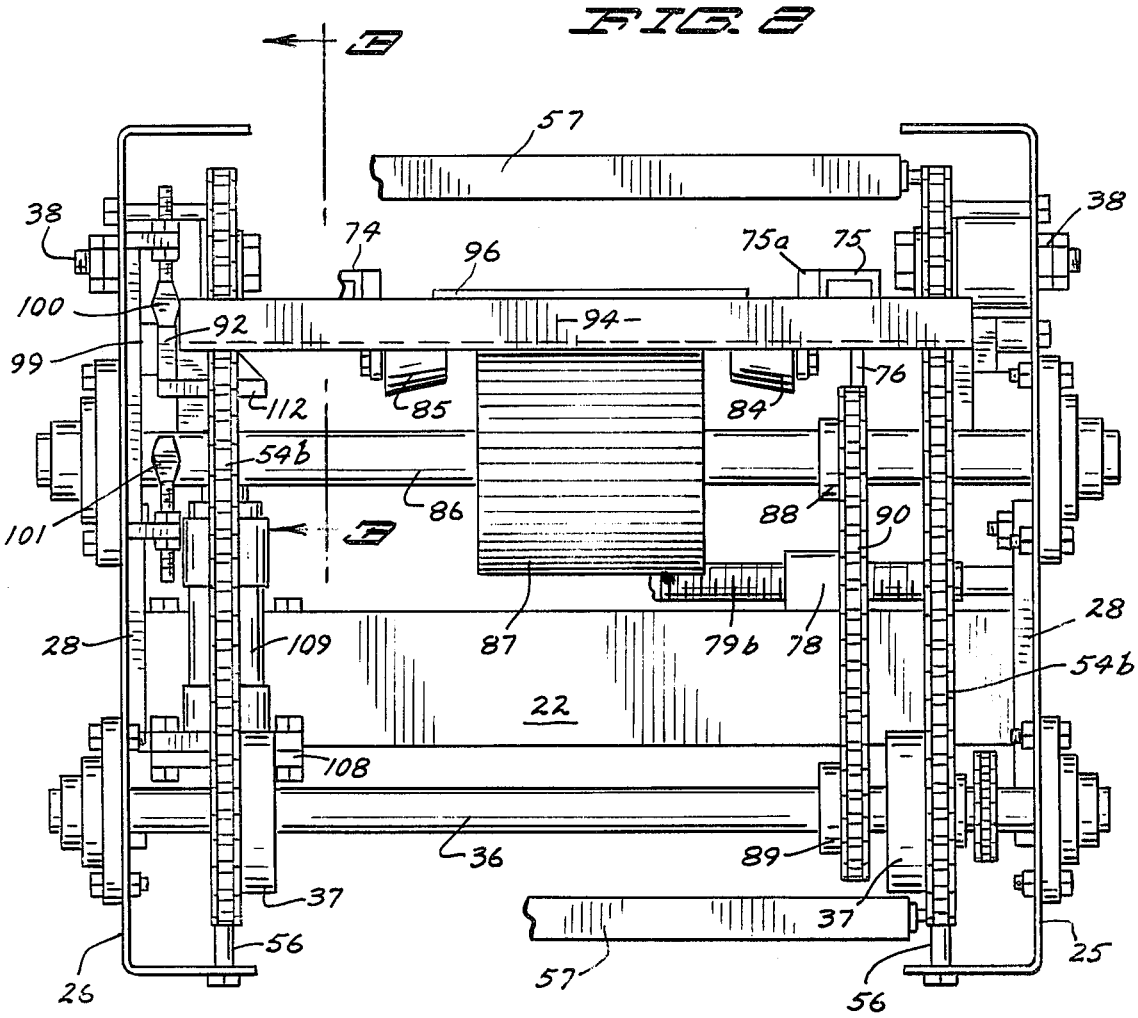
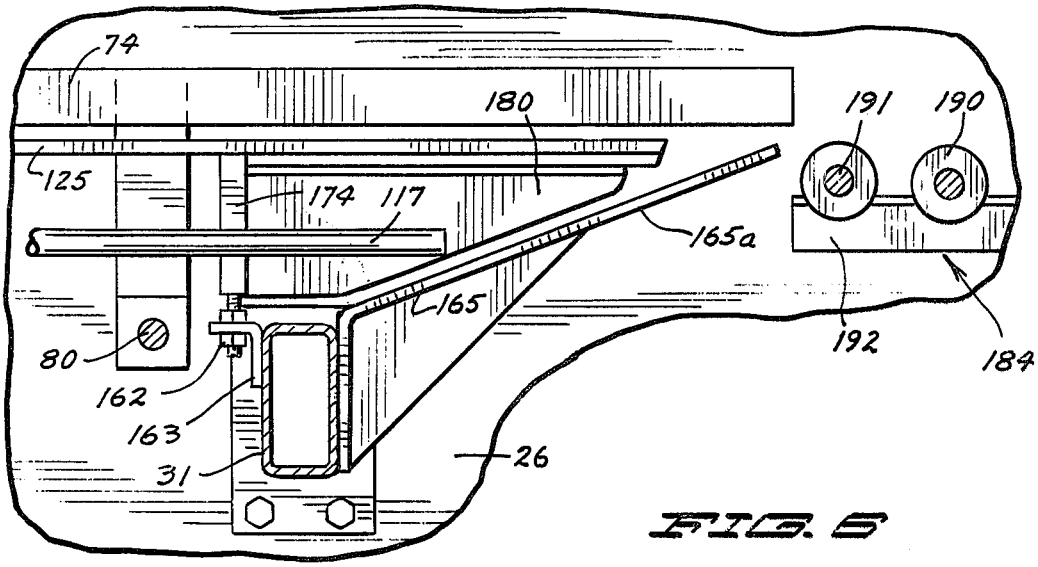
FIG. 6

FIG. 6
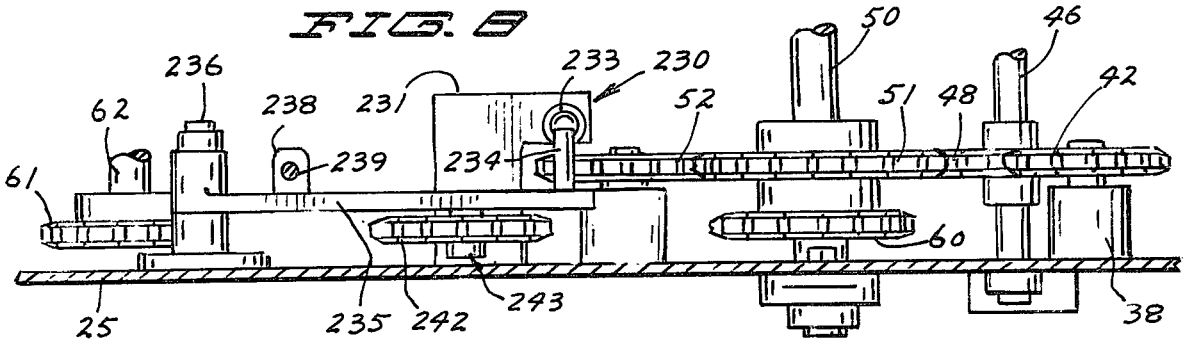
FIG. 7
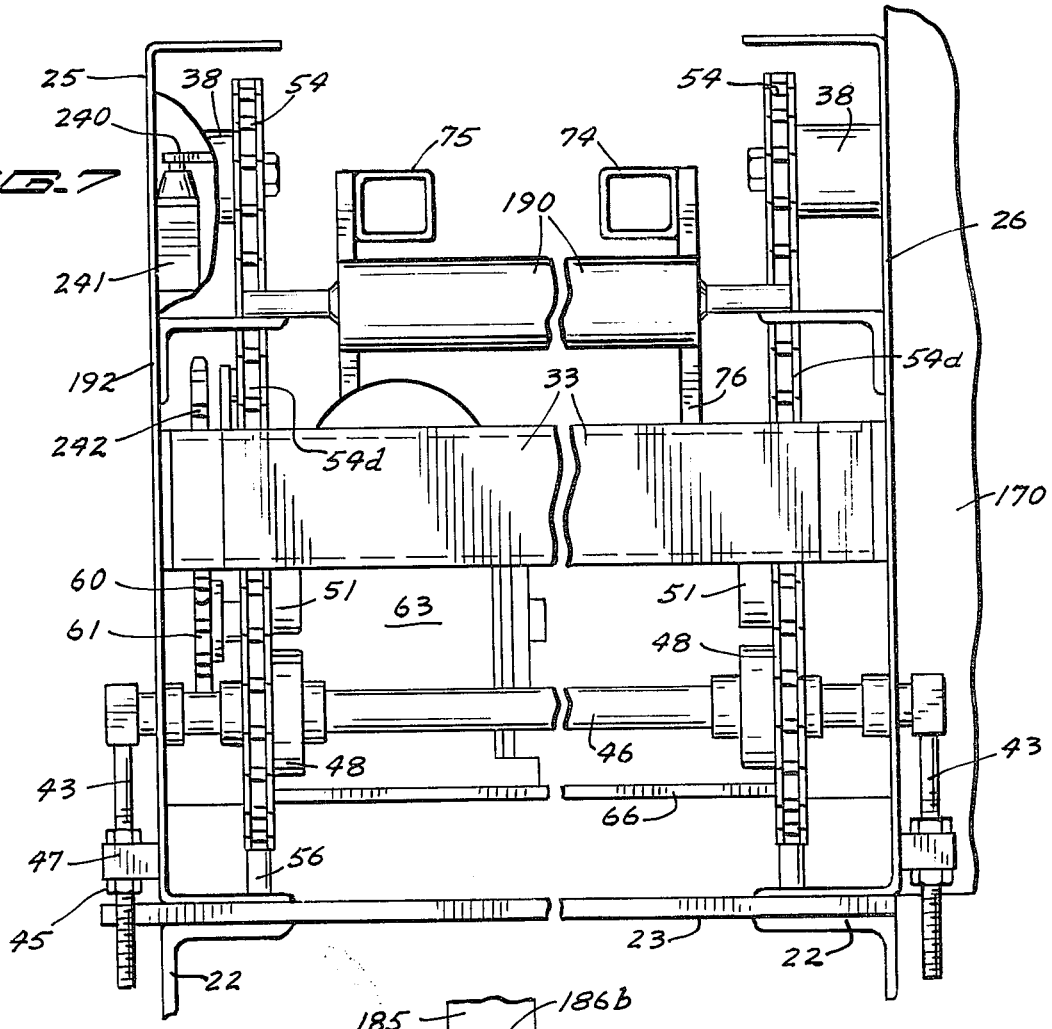
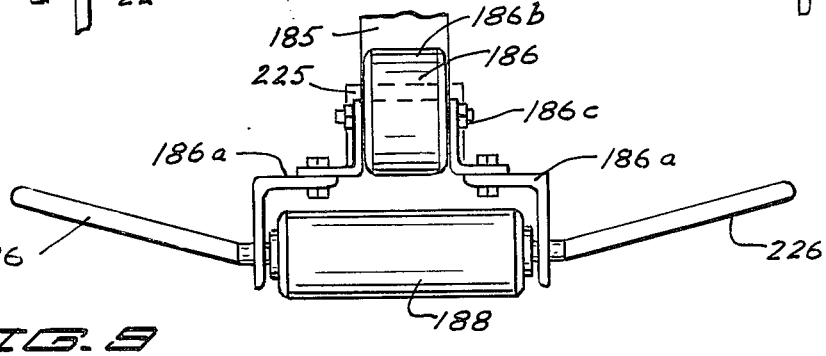
FIG. 9

CASE SEALER APPARATUS

BACKGROUND OF THE INVENTION

Case sealer apparatus for partially opening the major bottom flaps and forming a sealed bottom and top case closure.

It is old to provide machines for sealing flaps of filled cases to provide sealed bottom and top closures as the case is being moved through the machine, for example, see U.S. Pat. 2,324,401. In order to provide improvements in case sealing machines, this invention has been made.

SUMMARY OF THE INVENTION

In case sealing apparatus, endless chains on a frame for carrying flight bars to move a filled case forwardly, means for supporting the case and contents with the bottom major flaps slightly open, a slide plate to support the bottom minor flaps and case contents as the case is advanced, a movable package plate assembly between the slide plate and the above mentioned means for entering between the bottom leading minor flap and the slightly open bottom major flaps to further open the bottom major flaps while providing support for the bottom minor flaps, adhesive applying heads for applying adhesive to top and bottom flaps as the case is advanced over the slide plate, and closure means for moving the flaps into sealing rrelationship as the case is advanced.

One of the objects of the invention is to provide in a case sealing machine, new and novel means for further opening slightly open bottom major flaps of a filled case and providing support for product and the bottom minor flaps as a case is advanced. Another object of the invention is to provide in a case sealing machine, new and novel means for quickly stopping the drive to the machine in the event of a jam. A further object of the invention is to provide in a case sealing machine, new and novel means for controling the infeed of cases in timed relationship to the movement of flight bars for advancing the case through the machine.

BRIEF DESCRIPTION OF THE DRAWINGS

FIGS. 1A and 1B with the right side of FIG. 1A joined to the left side of FIG. 1B show a side elevational view of the apparatus of this invention, portions of the adjacent side frame plate being broken away for more clearly illustrating other structure, and part of the subframe and support structure being broken away;

FIG. 6 is an enlarged longitudinal cross-sectional view showing the structure for moving the bottom major flaps to a closed position;

FIG. 7 is a front end view generally taken along the line and in the direction of arrows 7—7 of FIG. 1B, a transverse intermediate part being broken away, the drive chain not being shown, and one of the socket mounts being broken away in order to illustrate the stop switch;

FIG. 8 is an enlarged fragmentary horizontal view generally taken along the line and in the direction of arrows 8—8 of FIG. 1B with the side plate top flange not shown to illustrate the mounting of various sprockets at the front end of the machine and the automatic stop mechanism;

FIG. 9 is a transverse view generally taken along the line and in the direction of arrows 9—9 of FIG. 1B to more clearly show part of the upper compression assembly and the top major flap closure rods;

Figures 2A, 3:
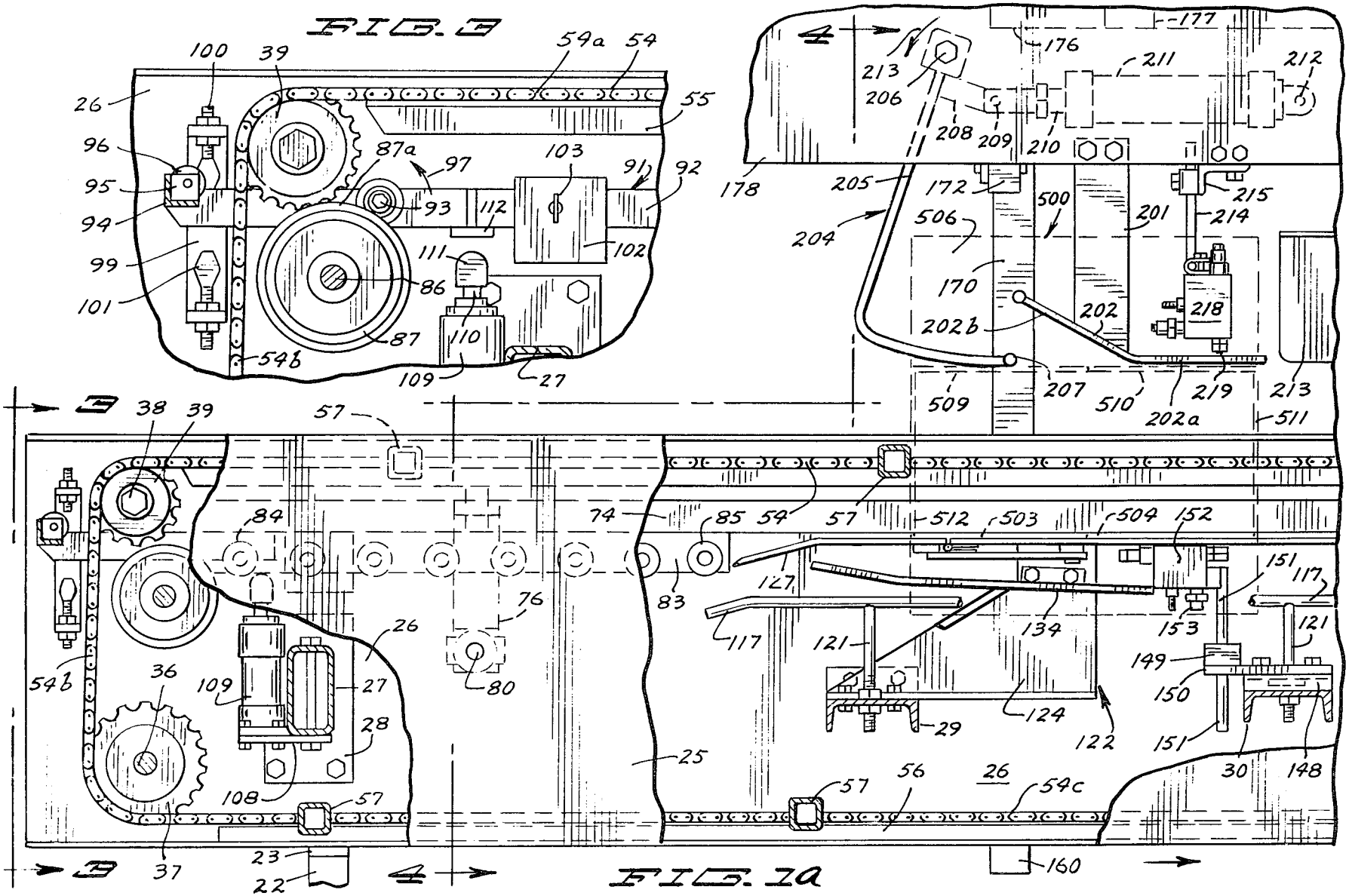
FIG. 3 is an enlarged longitudinal fragmentary view generally taken along the line and in the direction of the arrows 3—3 of FIG. 2 to more clearly show the case indexing gate assembly and adjacent structure.

Referring now in particular to FIGS. 1A, 1B, 2 and 7, the apparatus of this invention, generally designated 10, includes a frame, generally designated 11. The frame 11 includes a pair spaced, longitudinally elongated side plates 25 and 26 which are mounted on transverse frame members 23, the frame members being mounted on legs 22. The frame also includes a rear frame member 27 and an intermediate frame number 31, each of which at its opposite ends is secured to a mounting plate number 28 that in turn is bolted to the adjacent one of side plates 25 and 26. Intermediate frame members 27 and 31 there are provided transverse frame members 29 and 30 that extend between and are mounted by the side plates, while forwardly of frame member 31 there is provided a front frame number 33 that also extends between and is secured to the side plates.

Figure 2B:
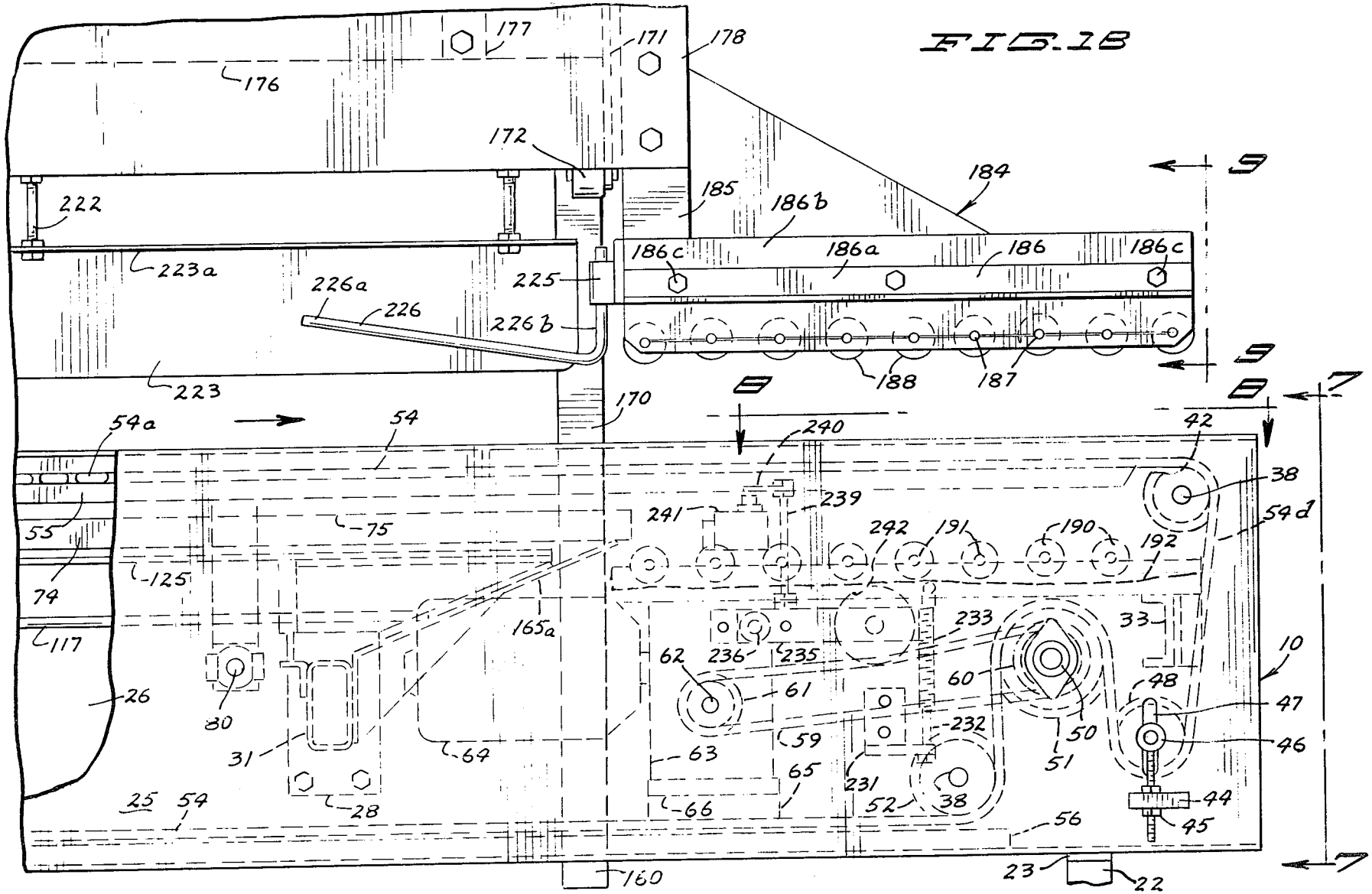
FIG. 2 is a rear end view of the apparatus of this invention, said view being generally taken along the line and in the direction of the arrows 2-2 of FIG. 1A, portions being broken away.

Rotatably mounted by the lower rear corner portions of the side plates is a transverse shaft 36 which in turn mounts transversely spaced sprockets 37 (see FIG. 2). Directly above each of these sprockets 37 there is provided an idler sprocket 39 that is mounted on the adjacent sidewall by a sprocket mount 38. Similarly, the front upper corner portions of the side plates mount sprocket mounts 38 which in turn rotatably mount sprockets 42. The lower front corner portions of the side plates are provided with vertically elongated slots 47 through which there is rotatably extended a transverse shaft 46. The shaft is rotatably mounted by eye members 43 which have lower threaded portions mounted by brackets 47 that in turn are secured to the side plates to extend outwardly thereof. Nuts 45 are threaded on the lower threaded end portions of the eye members for retaining the shaft 46 in selected vertically adjusted positions. Between the side plates, sprockets 48 are mounted on the shaft 46 to be spaced from the side plates the same distance as the previously described sprockets.

Rearwardly of shaft 46 and at an elevation intermediate that of shaft 46 and the upper front sprocket mounts 38, the side walls rotatably mount a drive shaft 50. Transversely spaced sprockets 51 are keyed to the drive shaft. At a lower elevation and a short distance rearwardly of sprockets 51 there are provided sprockets 52 that are rotatably mounted on the adjacent side walls by sprocket mounts 38, there being a sprocket 52 adjacent each of the side walls. An endless link chain 54 is mounted on sprockets 39, 37, 52, 51, 48, and 42 that are adjacent sidewall 26 while another link chain 54 is mounted on the corresponding sprockets that are adjacent sidewall 25. Thus, each link chain has an upper run 54*a* that extends rearwardly from sprocket 42 to sprocket 39 then partially around sprocket 39 to have a rear run 54*b* that extends to sprocket 37, thence along a lower run 54*c* from sprocket 37 to sprocket 52, next upperwardly to be reversely bent over sprocket 51, then downwardly to extend partially around sprocket 48, and thence upwardly along front run 54*d* to sprocket 42. Upper chain guides 55 are attached to the sidewalls for supporting the upper runs of the link chains 54 while lower chain guides 56 are mounted by side plates to support the lower runs of the chains. The chain guides 56 terminate a short distance forwardly of sprockets 52. A plurality of transverse case mover (flight) bars 57 are pivotally secured to link chains to move therewith, the bars being spaced from one another by a distance greater than the longitudinal length of the case to be processed through the machine of this invention.

In order to drive the drive shaft 50, a sprocket 60 is keyed thereto, there being a chain 59 trained around sprocket 60 and a sprocket 61 that is keyed to the output shaft 62 of the reducer 63 which is driven by motor 64 of the reducer motor combination 63,64. The combination 63, 64 is mounted by a transverse frame member 66 that in turn is supported by blocks 65 that are attached to the side plates.

Figure 4:
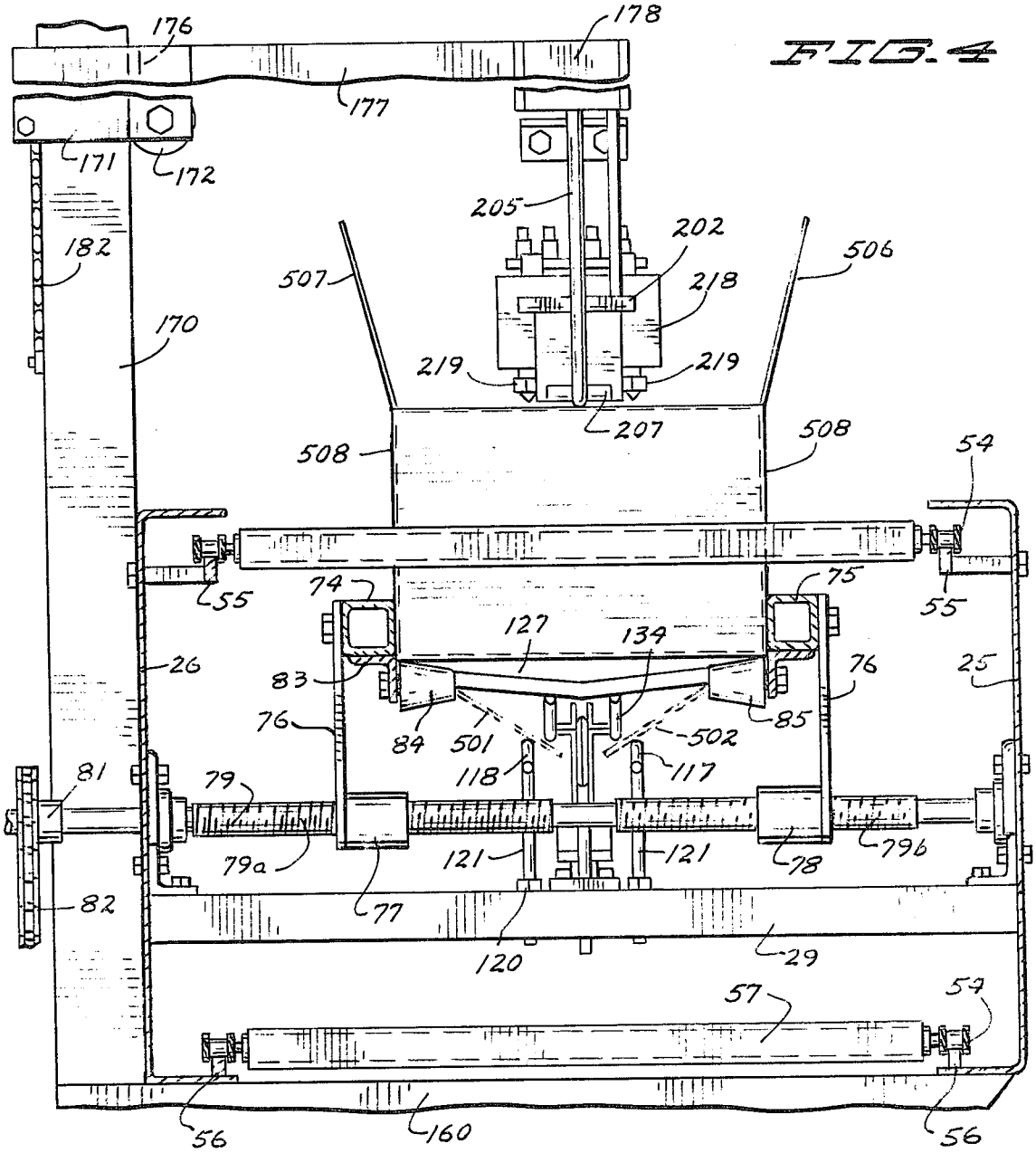
FIG. 4 is a transverse cross-sectional view generally taken along the line and in the direction of the arrows 4—4 of FIG. 1A with part of the top support mechanism being broken away.

To retain in case a transverse centered condition as it is moved through the rearward part of the machine by a case flight bar 57, that are provided longitudinally elongated, transversely spaced side guide bars 74 and 75 (see FIG. 4). Each of the guide bars is mounted on the upper ends of longitudinally spaced bars 76. The lower ends of bars 76 for guide bar 74 are secured to collars 77 while the bars 76 for the guide bars 75 are secured to collars 78. The collars 77 have internal threads that mate with threaded end portions 79A of the screw shaft 79 and 80 respectively and collars 78 have internal threads that form a mating fit with screw shaft portions 79B of screw shafts 79 and 80 respectively.

The direction of threading of portions 79B is opposite from that of portions 79A whereby when the shafts 79, 80 are rotated in one direction, the guide bars 74, 75 are moved transversely toward one another; and when rotated in the opposite direction, the guide bars are moved away from one another. To each of the shafts 79 and 80, there is keyed a sprocket 81, a chain 82 being extended around the sprockets to rotate the shaft 80 in the same direction and the same amount as shaft 79 is rotated. A hand crank (not shown) is provided for turning the shaft 79.

To each of the side guide bars 74 and 75 there is dependingly secured an angle iron 83, the angle iron secured to guide bar 74 mounting a plurality of longitudinally spaced frusto conical rolls 84 for rotation about transverse axes. Similarily the angle iron secured to guide bar 75 mounts a plurality of frusto conical rollers 85. As may be noted in FIG. 4, the major bases of the rolls 84, 85 are more remote from one another than their minor bases; the rolls 84 and 85 being of the same size and shape.

For controlling the feeding of the cases onto the frusto conical rolls 84, 85, there is provided an indexing assembly, generally designated 91 (see FIGS. 1*a*, 2 and 3). The indexing assembly includes longitudinally elongated bars 92 that at the intermediate portions thereof are pivotally mounted by pivot members 93 which in turn are mounted on the adjacent side wall. The bars 92 extend rearwardly of the rear runs 54*b* of the chains 54, and rearwardly of the rear runs mount a transverse angle iron(stop member) 94. Brackets 95 are mounted on the angle iron to rotatably mount a transverse roll 96 which extends to a slightly higher elevation than the rear vertical leg of angle iron. On the end portion of one of the bars 92 that is on the opposite side of the pivot 93 from the angle iron, there is slidably mounted a counterweight 102, there being provided a lock screw 103 for locking the counterweight in a select adjusted position on said bar. Thus the counterweight acts to pivot bars 92 to move the angle iron in an upward direction.

Stop mechanism is provided for limiting the pivotal movement of the bars 92, the stop mechanism including a stop guide 99 that is mounted on the side wall 26. The guide 99 has an upper flange that mounts a screw bumper 100 in a vertically adjusted position for abutting against the adjacent arm 92 to limit the pivotal movement thereof in one direction while on the lower flange of the guide there is mounted a screw bumper 101 for abutting against arm 92 to limit the pivotal movement thereof in the opposite direction. Nuts are threaded on the threaded end portions of the screw bumpers to permit selectively adjusting the elevation thereof.

For pivoting the arms 92 to lower the angle iron, there is provided a bracket 108 that is secured to the frame member 27, the bracket mounting a cylinder 109 that is part of the piston cylinder combination 109, 110. The piston cylinder combination includes a piston rod 110 which mounts a bumper 111 vertically beneath a bracket 112 that is secured to the arm 92 adjacent plate 26 at a location longitudinally between pivot 93 and the counterweight. When air under pressure is applied to the lower end of cylinder 109, the bumper 111 moves upwardly to move the bracket 112 in the same direction whereby the arms 92 are pivoted in the direction of the arrow 97. The pivoting in the direction of the arrow 97 is limited by arm 92 abutting against bumper 101.

A short distance forwardly of the chain rear runs 54*b* there is provided a transverse shaft 86 to which there is keyed a feed roll 87, the shaft being rotatably mounted by the side plates. The feed roll has a rough exterior surface, the upper circumferential portion 87*a* of the feed roll being at a higher elevation than the upper surface of roll 96 when the roll 96 is in its lower limit position, while the upper surface portion of roll 96 is at a higher elevation than the upper surface portion of the feed roll when the roll 96 is in its upper limit position. Further, the roll 96 is at a lower elevation than the bottom of the case on a separate conventional infeed conveyor assembly (not shown) for feeding the case to the apparatus of this invention; while when the roll 96 is in its upper position, the angle iron 95 blocks the movement of the case from the infeed conveyor to the feed roll 87 to be advanced thereby.

For driving the feed roll, a sprocket 88 is keyed to shaft 86, sprocket 88 being driven by a chain 90 that is extended around a sprocket 89 which in turn is keyed to shaft 36. The feed roll is driven at a linear speed that is greater than the linear speed of movement of the case flight bars.

Adjacent the forward ends of the angle irons which mount the frusto conical rolls, there is provided bottom flap guide rods 117, 118 which are longitudinally elongated and transversely spaced from one another. The guide rods 117, 118, other than for their rear end portion, extend horizontally while the rear end portions extend downwardly and rearwardly to terminate at a location that is rearward of the transverse vertical plane of the axis of rotation of the forward most pairs of rollers 84, 85. The guide rods are supported by vertical rods 121 that have lower end portions extended through frame members 29 and 30 respectively, there being provided nuts threaded on the lower end portions of the rods for retaining the rods 121 at the desired selected elevations.

Figure 5:
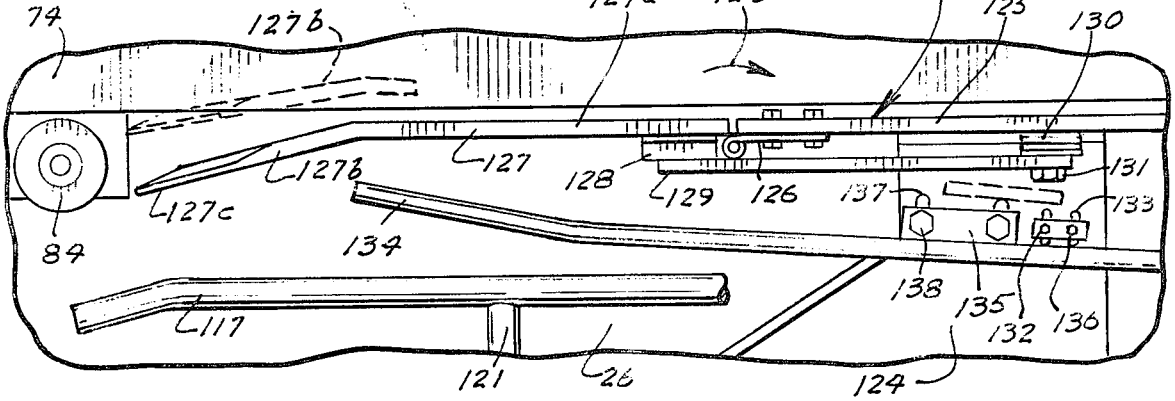
FIG. 5 is a fragmentary longitudinal cross-sectional view showing the package plate assembly for entering between the bottom leading flap and the bottom major flaps, the package plate being shown in a datum position in dotted lines and in a position having a case moved thereover in solid lines.

For aiding in guiding the bottom major flaps of a case at angles to adhesive applied thereto, as a case is advanced, there is provided transversely spaced upper guide rods 134. The rods 134 extend downwardly in a forward direction and are located at a higher elevation than the horizontal parts of rods 117, 118 and are more transversely closely adjacent one another than rods 117, 118. To mount each rod 134, there is provided a bracket 135 that is secured to the respective rod and bolted to an upwardly extending bracket 124 by bolts 138 that are extended through vertically elongated slots 137 in bracket 124 to permit vertically adjustably positioning rods 134 (see FIG. 5). The bracket 124 is mounted by frame member 29.

For initially separating the bottom major flaps from the remainder of the case and transferring the support of the case and contents from the major flaps to the minor flaps as the case is being moved forwardly, there is provided bottom flap spreader slide assembly, generally designated 122. The spreader assembly includes a horizontally elongated slide plate 125 that at its rear end is mounted on the upper end of bracket 124 to extend transversely outwardly of either side thereof. The rear end of the slide plate mounts one hinged element of a hinge 126 having a transverse hinge axis, the other hinge element being extended between and secured to spacer 128 and the front end of package plate 127. The plate 127 has a front end portion **127*a* that extends substantially planar, and a rear end nose portion 127*b* that extends downwardly in a rearward direction from the rear end of portion 127*a*. Further, portion 127*b* has a generally triangular terminal rear part 127*c* that has the apex thereof extending further rearwardly and transversely centered relative the guide rods 117, 118. Additionally the terminal edge parts of part 127*c*** are beveled to aid in the triangular part moving between the bottom major flaps and the bottom minor flaps as the case is moved forwardly.

Transversely spaced spacer bars 129 extend, one on either side of the bracket 124 to have their rear end portions secured to spacer 128 and their forward end portions located a substantial distance forwardly of the transverse, horizontal hinge axis of hinge 126. The front end of each bar 129 mounts a bolt 131 that has a coil spring 130 extended therearound to bear against the bar and the slide plate 125 for resiliently urging the bar to pivot the package plate in the direction of the arrow 123 about the hinge axis to the package plate datum position. Stops 132 have bolts 136 extended therethrough and through vertically elongated slots 133 for mounting the stops in vertically adjusted positions on the bracket 124 for limiting the downward movement of the front ends of bars 129. When the package plate is in its datum position, the bolts 131 abut against stops 132 and the pointed rear end of part **127*c* is located at an elevation vertically intermediate the major and minor bases of the rolls 84, 85 at a short distance forwardly of the forward most rolls. However, the case leading sidewall in moving in advance of the point of the package plate pushes the part 127*c* down to the solid line position of FIG. 5 wherein the point of part 127*c* is located vertically intermediate the lower part of the major and minor bases of the rolls 84, 85, while portion 127*a*** of the package plate extends substantially horizontally.

A bottom glue head 152 is mounted adjacent the forward ends of guide rods 134 and has downwardly directed nozzles 153 for discharging glue (hot melt adhesive) onto the upper surfaces of the bottom major flaps as they pass therebeneath. The glue head is mounted on the upper end of a vertical rod 151 that is retained in a selected vertical adjustment by a collar 149 which in turn is mounted on a bracket 150. The bracket 150 is mounted by glue head mount 148 that permits the bracket to be longitudinally and transversely adjustably positioned, the glue head mount being mounted on frame member 30.

Forwardly of the glue head there is provided a mount 174 that mounts the front end portion of the slide plate 125 (see FIG. 6), the lower end portion of the mount being threaded and retained in an adjusted vertical position on a support bracket 163 by nuts 162. Bracket 163 is secured to frame member 31. Also mounted by frame member 31 is a bottom flap enclosure plate 165 that includes a generally planar portion **165*a* that is inclined upwardly in a forward direction. The rearward part of the planar portion 165*a* is located a substantial distance rearwardly of and at a lower elevation than the front end of guide rods 117, 118, and is in underlying relationship to said guide rods. The front end of portion 165*a* is located forwardly of slide plate 125** and at about the same elevation.

Extending forwardly of the front part of the flap closure **165*a* there is a compression assembly generally designated 184. The compression assembly 184 includes a pair of longitudinally elongated angle irons 192 that are mounted by side plates 25 and 26 respectively (see FIGS. 1B, 6 and 7). The angle irons mount a plurality of transversely elongated shafts 191 in parallel relationship. Each shaft rotatably mounts a roller 190, the upper surface portions of the rollers being slightly below the top surface of the slide plate 125. The rearward most roller is located just forwardly of the front end of the closure plate portion 165*a***.

Vertically above the rollers 190, there is provided a plurality of transversely elongated rollers 188, the rollers 188 being rotatably mounted by transverse shafts 187. The shafts 187 are mounted by an upper compression roller support 186. The support 186 is mounted by vertical frame member 185, the support 186 including elongated brackets **186*a*, one on either transverse side of support member 186*b*, for mounting the shafts 187. Bolts 186*c* are extended through slightly oversized holes for securing the brackets to the support member while permitting limited vertical movement of the brackets relative the support member. This permits limited vertical movement of rollers 188** to provide an accommodation for small variations in the heights of cases.

Figure 10:
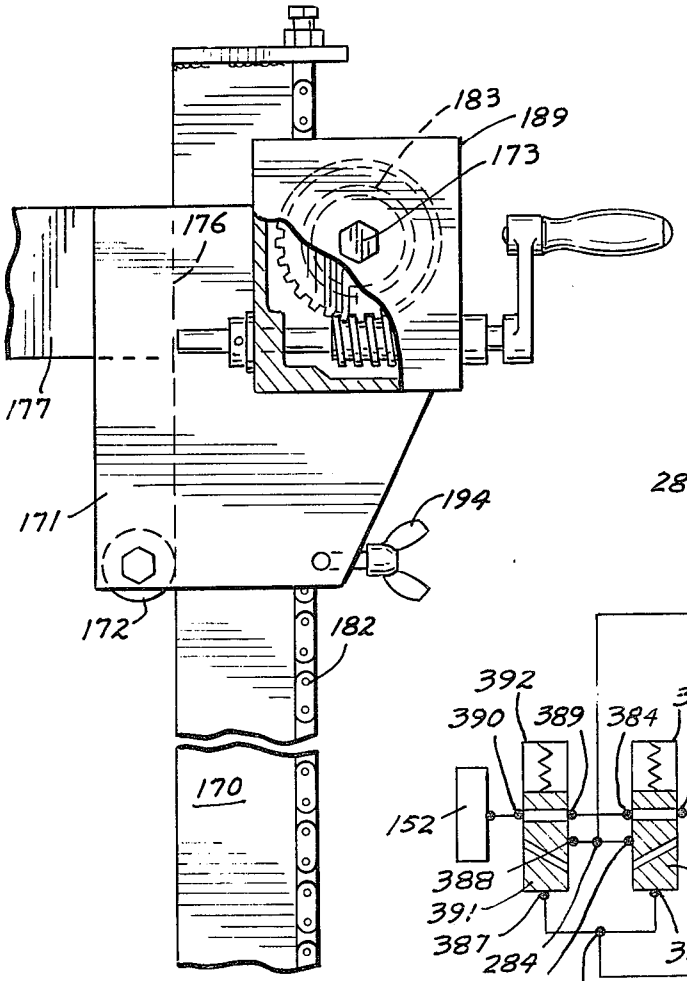
FIG. 10 is a fragmentary transverse view showing structure for selectively varying the height of the subframe and the structure mounted thereon, parts being broken away.

For mounting the frame member 185 and other structure, there are provided a pair of transverse frame members 160 that are secured to the lower ends of the side plates 25, 26. The one ends of the frame members 160 mount uprights 170 which are longitudinally spaced from one another. On the remote sides of the uprights are mounting plates 171, a longitudinally elongated support frame member 176 extending between and being bolted to the mounting plates. One lower corner portion of each of the mounting plates rotatably mount a roller 172, the roller bearing against one vertical, longitudinal surface of the adjacent upright. For retaining the mounting plates 171 and support frame member 176 in a vertically adjusted position, on the side opposite of each upright against which roller 172 bears, there is mounted a vertically elongated link chain 182 (see FIG. 10). A sprocket 183 engages each adjacent chain so that as the sprockets are rotated the sprockets will move vertically relative to the chains. The sprockets are keyed to a longitudinal shaft 173 which is rotatably mounted by the adjacent mounting plate 171. A worm gear drive device 189 is mounted on one of the mounting plates 171 are drivingly connected to shaft 173 for selectively rotating shaft 173 and thereby varying the elevation of the structure mounted by the mounting plates 171. Hand operable clamp mechanism 194 that includes a clamp block (not shown) abuttable against one of the chains 182 is mounted on one of the mounting plates to releasably return the mounting plate in a vertically adjust position.

The longitudinal support bar 176 mounts the one ends of longitudinally spaced, transversely elongated support bars 177 that extend transversely outwardly in an overhanging relationship to the transversely intermediate part of the machine. The ends of the support bars 177 opposite the support bar 176 mount a longitudinally elongated upper subframe 178 which is transversely centered relative the side plates 25, 26. The forward end of the upper support frame member mounts the vertical frame member 185 to extend therebeneath.

The subframe 178 dependingly mounts a bracket 201 which in turn mounts a minor flap closure member 202 (see FIG. 1A). The closure member 202 has a horizontal, generally planar front end portion **202*a* and a rear end portion 202*b* that is inclined upwardly in a rearward direction. The closure member 202** is provided for closing the top leading minor flap and retaining it in a closed position while adhesive is applied thereto.

For closing the trailing top minor flap, there is provided a tucker assembly, generally designated 204, that includes a generally L shaped rod 205 that at one end mounts a transverse closure rod 207. The opposite end of the rod 205 is pivotally on the subframe by a transverse pivot member 206. A bar 208 is connected to the rod 205 adjacent the pivot member and is pivotally connected at 209 to the piston rod 210 of a piston cylinder combination 210, 211. The cylinder 211 is pivotally connected at 212 to the subframe 178. When the piston rod is moved from its extended position to its retracted position, rod 205 is pivoted in the direction of the arrow 213 to pivotally swing the closure rod 207 from a rearward elevated (datum) position to a forward and lower position that is illustrated in FIG. 1A whereby the top trailing minor flap is moved from a vertical position to a closed position as the case is being advanced by a flight bar 57.

For applying adhesive to the top minor flaps, there is provided a glue gun 218 that is dependingly mounted by a vertical rod 214. The vertical rod is secured in a vertically adjusted position by a bracket 215 that is mounted by the subframe 178. The glue gun had nozzles 219 for applying adhesive to the top case minor flaps on either transverse side of the closure member portion **202*a***.

Rods 222 are secured to the subframe 178 and to a horizontal top flange of the spline 223 for mounting the spline in a transversely centered position relative the movement of the case therebeneath (see FIG. 1B). The spline is longitudinally elongated to extend the major part of the distance between closure member 202 and the upper compression rolls 188, the part of the spline other than for a horizontal flange being vertical. The spline retains the top minor flaps in a closed condition as the minor flaps move from beneath closure member **202*a*** to the compression assembly.

For closing the top major flaps after adhesive has been applied to the top minor flaps, there are provided a pair of transversely spaced closure rods 226, one extending on either transverse side of the spline 223. The closure rods have rear end portions **226*a* that converge in a forward and downward direction. Portions 226*a* extend predominantly horizontally and are joined to vertical portions 226*b* that are mounted in vertically adjusted positions by brackets 225. The brackets 225 are mounted by the vertical frame member 185**.

For stopping the machine in the event it becomes overloaded, there is provided an overload mechanism, generally designated 230, that includes a sprocket 242 rotatably mounted by an elongated arm 235 in a position to engage the upper run of drive chain 59 (see FIGS. 1B, 7 and 8). An arm pivot 236 pivotally connects one end of the arm 235 to the side plate 25 while the opposite end of the arm mounts the spring mount 234 which mounts the upper end of a generally vertically extending coil spring 233. The opposite end of the spring 233 is secured to an adjustment bolt 232 that has a threaded end portion extended through bracket 231. A nut is threaded on the threaded end portion whereby threading the nut will result in a variance of spring pressure exerted on arm 235. Bracket 231 is mounted by the side plate 25. A lug 238 is secured to the arm 235 intermediate pivot 236 and the sprocket 242, the lug mounting the lower end of a vertical bolt 239. The threaded end portion of the bolt mounts a valve actuator 240, therebeing provided nuts for holding the actuator on the bolt in vertically adjusted positions. The actuator is extended into overhanging relationship to the valve member 313 (FIG. 11) of a valve 241 that is connected in a circuitry to be described for powering motor 64.

When more than a predetermined force is required for driving the sprocket 60, for example, some object caught between the flight bar and another part of the machine, the upper run of chain 59 is straightened whereby the sprocket 242 is moved upwardly against the spring action of spring 233. The upward movement of the sprocket pivots arm 235 in a direction to elevate the valve actuator 240 which results in valve member 313 opening and the motor being de-energized.

Figure 11:
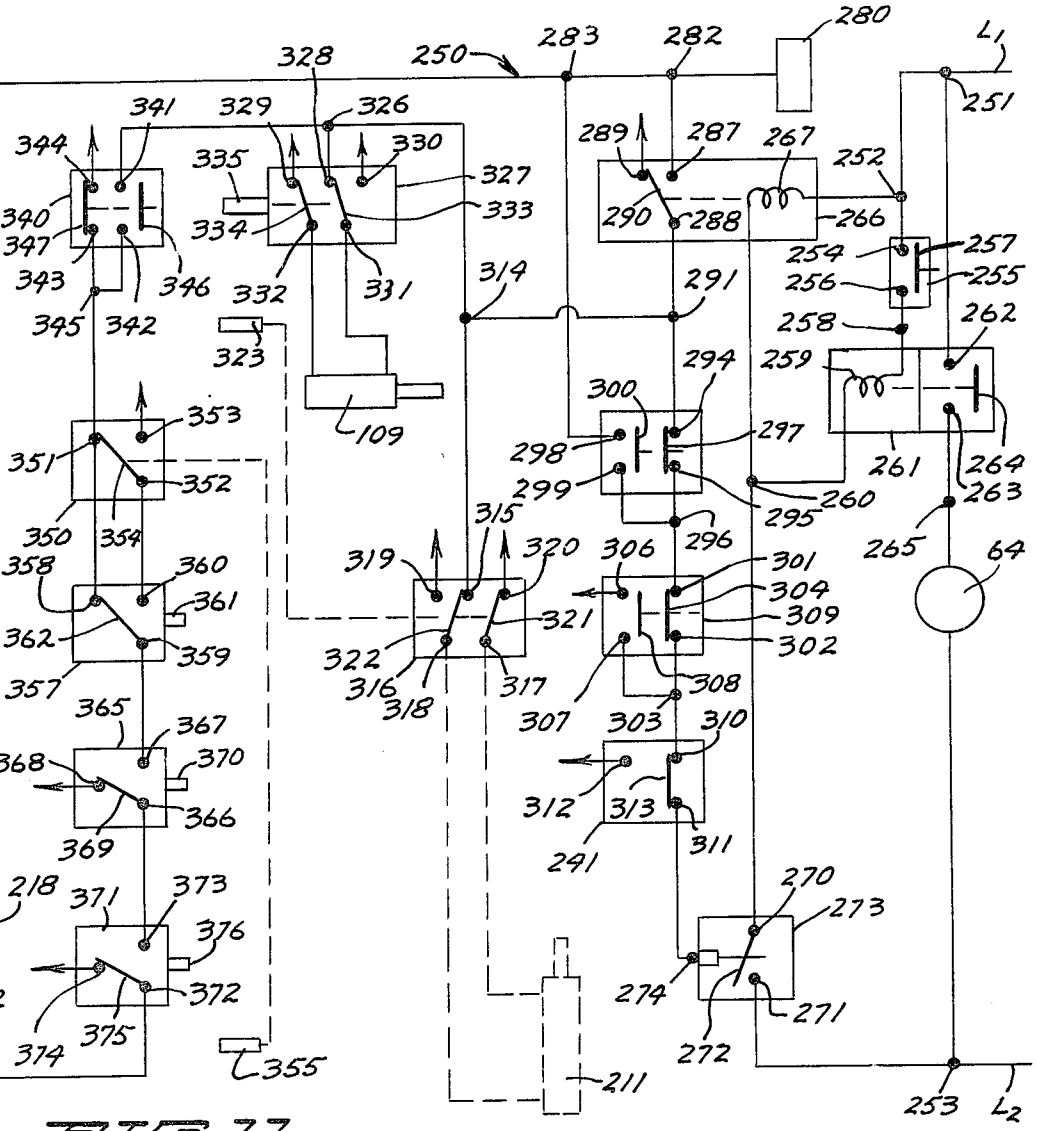
FIG. 11 is a schematic showing of the control circuitry and components.

Referring now to FIG. 11, the control circuitry and components, generally designates 250, includes a main electric power line $L_1$ having junctions 251 and 252 thereon, and a main power line $L_2$ that is connected to a terminal 271 of pressure actuated valve 273. Junction 252 is connected to a terminal 254 of a manually operated on-off switch 255, switch 255 including a terminal 256 connected to junction 258, and a switch member 257 that upon being manually depressed electrically connects terminal 254, 256.

A solenoid coil 259 of a solenoid relay 261 is connected across junctions 258, 260; this relay including a terminal 262 that is connected to junction 251 and a terminal 263 that is connected to a junction 265. The relay also includes a switch member 264 that electrically connects terminals 262, 263 when coil 259 is energized, and upon the coil beginning de-energized, breaks the aforementioned electrical connection. The motor 64 is connected across junctions 265 and 253.

A solenoid coil 267 of a solenoid operated valve 266 is connected across junctions 252, 260.

The pneumatic circuitry portion of the controls includes a source of pressurized air 280 that is connected to air line 281, the line 281 having junctions 282, 283, and 284 thereon. Junction 282 is connected to inlet port 287 of the solenoid operated valve 266 the valve having an outlet port 288 that is connected to a junction 291, an exhaust port 289, and a valve member 290 that in a solenoid coil de-energized condition fluidly connects ports 288, 289; and in the solenoid coil energized position, fluidly connects ports 287, 288. Junction 291 is connected to port 294 of the push button pneumatic start switch 293, the start switch including a port 295 connected to junction 296, a port 299 as connected to junction 296 and a port 298 connected to junction 283. Further, switch 293 includes valve members 297 and 300 that are resiliently retained in positions that valve member 297 fluidly connects port 294 to port 295, and that valve member 300 breaks the fluid connection between ports 298, 299; but while being manually depressed, valve member 300 fluidly connects ports 298, 299 and valve member 297 breaks fluid connection between ports 294, 295.

Port 301 of a push button pneumatic stop switch 309 is connected to junction 296, the stop switch including ports 302 and 307 that are connected to junction 303, an exhaust port 306, and valve members 304, 308 that are manually operated and retained in positions that they have been manually moved to. When moved to a stop position, valve member 304 breaks the fluid connection between ports 301 and 302 while valve member 308 fluidly connects port 307 to exhaust port 306.

Junction 303 is connected to port 310 of valve 241, valve 241 including port 311 that is connected to port 274 of pressurized actuated switch 273, an exhaust port 312 and a valve member 313. Valve member 313 is resiliently retained in a position to fluidly connect ports 310, 311, but upon being depressed fluidly connects ports 311, 312. Pressure switch 273 is of a conventional type that when no fluid under pressure is applied to port 274, there is no electrical connection between terminals 270, 271, but upon fluid under pressure being applied to port 274, switch member 272 is moved to a position to electrically connect terminals 270, 271 and remains in this position until the pressure at port 274 is relieved.

Junctions 291 is connected to junction 314 which in turn is connected to the inlet port 315 of the pneumatic tucker valve 316. Valve 316 includes exhaust ports 319, 320, a port 317 connected to one end of cylinder 211, a port 318 that is connected to the opposite end of said cylinder, and valve members 321 and 322. The valve also includes an arm actuator 323 connected to valve members 321, 322 that resiliently retains valve member 321 to fluidly connect port 317 to port 320 and valve member 322 to fluidly connect port 318 to port 315. However, upon the arm actuator being moved by a case, it results in valve member 321 connecting port 315 to port 317 and valve member 322 connecting port 318 to the exhaust port 319.

Junction 314 is also connected to junction 326 which in turn is connected to the inlet port 328 of the pneumatic timing valve 327, valve 327 having exhaust ports 329 and 330, a port 331 that is connected to the upper end of cylinder 109, a port 332 that is connected to the lower end of said cylinder, a valve member 334 that is resiliently retained in a position to connect ports 329, 332, a valve member 333 that is resiliently retained to connect port 328 to port 331, and an actuating arm 335 that upon being moved by a case, moves valve member 333 to fluidly connect port 331 to exhaust port 330 and valve member 334 to connect port 332 to port 328.

Junction 326 is connected to the inlet port 341 of a manually operated pneumatic on-off valve 340, valve 340 also includes an exhaust port 344, ports 342 and 343 that are connected to junction 345, and valve members 346, 347. When valve 340 is manually operated to an off position, valve member 347 fluidly connects ports 343, 344 and valve member 346 breaks the fluid connection between ports 341, 342. Upon operating valve 340 to an on position, valve member 346 fluidly connects port 341 to port 342 while valve member 347 breaks the fluid connection between ports 343 and 344.

Junction 345 is fluidly connected to the inlet port 351 of the pneumatic glue control valve 350, valve 350 having a port 352, an exhaust port 353, a valve member 354, and an arm actuator 355 connected to valve member 354 that is resiliently retained in a position that said valve member 354 connects port 351 to port 352; but upon being actuated by the arm actuator to an actuated position by a case abutting there against, valve member 354 breaks the fluid connection between ports 351 and 352, and establishes a fluid connection between ports 352, 353.

Port 351 is fluidly connected to the inlet port 358 of the pneumatic glue control valve 357, valve 357 having a port 360 fluidly connected to port 352, a port 359, a valve member 362 and an arm actuator 361. The arm actuator is resiliently retained in a position that valve member 362 fluidly connects port 358 to port 359, however, upon the arm 361 being moved to an actuated position by a case abutting there against, valve member 362 is moved to break the fluid connection between port 358 and port 359 and to establish a fluid connection between port 359 and port 360. Port 359 is fluidly connected to port 367 of a pneumatic glue control valve 365, valve 365 having an exhaust port 368, a port 367, a valve member 369, and an arm actuator 370. The arm actuator and valve member 369 are resiliently retained in a position to fluidly connect port 366 to port 368, however, as a case is moved into abutting engagement with the arm actuator, it operates valve member 369 to break the fluid connection between ports 366, 368, and to establish a fluid connection between ports 366 and 367.

Port 366 is fluidly connected to the inlet port 373 of a pneumatic control valve 371, an exhaust port 374, a port 372, a valve member 375 and an arm actuator. The actuator 376 and a valve member 375 are resiliently retained in a position to fluidly connect port 372 to port 374, and upon the arm being moved to an actuated position by a case abutting thereagainst, valve member 375 is moved to break the fluid connection between ports 372, 374, and establish a fluid connection between ports 372 and 373.

Port 372 is connected to a junction 379, junction 379 being connected to a port 380 of the upper glue head control valve 381. The valve 381 also includes exhaust port 384, a port 383 that is fluidly connected to the glue head 218 for applying fluid under pressure thereto, a port 384, and a valve member 382 that is resiliently retained in a position to fluidly connect port 383 to port 384 and to block port 385. However, during the time that fluid under pressure is applied to port 380, valve member 382 is moved to and retained in a position that the exhaust port is blocked and port 383 is fluidly connected to port 385.

Port 385 is connected to junction 284 which in turrn is connected to port 388 of a bottom glue control valve 392. Valve 392 includes an exhaust port 389, a port 390 that is fluidly connected to the bottom glue gun for pressurizing the gun when pressure is applied at port 390, a port 387 that is connected to junction 379, and a valve member 391 that is resiliently retained in a position to fluidly connect port 390 to port 389. However, when and during the time fluid under pressure is applied at port 387, valve member 391 is moved to block the exhaust port and to fluidly connect port 388 to port 390.

In using the apparatus of this invention, filled cases, generally designated 500, are fed thereto by a conventional infeed conveyor (not shown) with their bottom flaps closed (major flaps 501, 502 beneath the minor flaps 503, 504), the top major flaps 505, 506 extending vertically extending slightly transversely outwardly of the major side walls 508, and the top minor flaps 509, 510 vertical, or preferrably tucked slightly inside the major flaps. The leading minor side wall 511 of the leading case on the infeed conveyor is advanced until it abuts against the stop bar 94 which stops the advancing movement of the case (referred to as first case) on the infeed conveyor.

Also, preparatory to sealing filled cases, air under pressure from source 280 is applied to line 281 and switch 255 is operated to electrically connect terminals 254, 256. Also the glue valve 340 is switched on whereby port 341 is fluidly connected to port 342 and the fluid connection between the ports 343, 344 is broken. Now the start switch valve 293 is operated to its on position whereupon air under pressure is applied at port 274 to move switch member 272 to a closed position. Switch member 272 in closing results in solenoid coil 259 being energized to close switch member 264 for energizing motor 64; and solenoid coil 267 being energized so that port 287 is fluidly connected to port 288. Now upon releasing the start switch valve, its valve members 297, 300 returns to break the fluid connection between ports 298, 299 and reestablish a fluid connection between ports 295, 294, it being noted that during this time port 274 remains pressurized.

Since the motor 64 is running, a flight bar 57, designated first flight bar for the purpose of describing this invention, is moved along the rear run **54*b* and forwardly along the upper run whereby it engages the arm 335 of the timing valve to actuate the timing valve. This results in fluid under pressure being applied from port 328 to port 332 whereby fluid under prssure is applied to the lower end of the cylinder 109 whereby bumper 111 is moved in an upward direction. This results in stop bar 95 being moved downwardly to permit the first case on the infeed conveyor being moved thereby over the stop bar and onto the feed roll 87. As the first case moves over the stop bar in abutting relationship to roll 96, the first flight bar moves out of engagement with arm actuator 335 whereby port 332 is connected to the exhaust and the bumper moves down. However, the first case holds the stop bar down. Since the linear speed of the periphery of the feed roll 87 is greater than that of the infeed conveyor, the feed roll causes the first case to advance sufficiently fast to create a gap between the first case and the following case (second case) on the infeed conveyor. As the first case moves in advance of the stop bar, it moves up into the gap between the first case and the second case to block the advancing movement of the second case. As the first case is advanced by the feed roll it is moved onto the frusto conical rolls to be supported thereby prior to the second flight bar (one following the first flight bar) being carried by run 54*b* coming into contact with the trailing sidewall 512 of the first case. The second flight bar in advancing along the upper run 54*a* comes into abutting engagement with the trailing sidewall of the first case to advance it through the apparatus of this invention, the second flight bar in moving along the upper run moves to abut against arm 335 which results in the valve 327 being actuated to operate the indexing mechanism such that the second case is moved into the machine of this invention as described with reference to the first case. As the first case moves onto the frusto conical rolls 84**, due to the taper of the rolls, the major side flaps open slightly while providing sufficient support for the bottom minor flaps to prevent the material in the case falling out of the case.

As the first flight bar moves the first case, the first case is first initially completely supported by the rolls 84, 85 and then as the case is further advanced, it engages the rear part of the package plate 127. The forward part of the nose **127*b* is at a higher elevation than the bottom edge of the advanced side wall while the apex part thereof is at a lower elevation whereby entry of the apex portion of nose between the bottom edge of the leading sidewall and the adjacent part of the bottom major flaps is facilitated. As the case advances it abuts against the forward part of the nose to pivot the package plate 127 opposite the direction of the arrow 123 while the leading bottom minor flap moves into engagement with the package plate to be supported thereby. The package plate in supporting bottom minor flaps and case contents, and the case moving in advance of rolls 84, 85 results in the bottom major flaps opening sufficiently that one major flap extends between the lower guide rod 117 and the adjacent upper guide rod 134 while the other major flap extends between the lower guide rod 118 and the adjacent upper guide rod 134. As the case advances over the portion 127*a*, portion 127*a* is retained in a horizontal condition due to bolts 130 abutting against plate 125 while the nose part of the package plate extends to a sufficiently lower elevation that it will be beneath the leading edge of the trailing bottom flap whereby said leading edge plus the case contents will be moved upwardly to the elevation of the top surface of plate portion 127*a* as the case is advanced. Due to the guide rods 134 being downwardly inclined the bottom major flaps are moved to a further open condition while the bottom minor flaps are being supported and moved onto the slide plate 125** to be supported thereby.

Just shortly after the front part of the case has been moved to be supported by the slide plate 125, the leading top minor flap is moved into abutting relationship with the top closure member 202, which folds the flap down to a horizontal condition. After the top leading minor flap has moved into engagement with the closure member 202, the top trailing minor flap is moved horizontally in advance of the closure rod 207. Thence the leading end wall of this case is advanced to abut against the tucker valve arm 323 to move it so that tucker valve members 321, 322 are operated to fluidly connect port 315 to port 317 and port 318 to exhaust port 319. This results in air under pressure being applied to cylinder 211 to retract its piston rod and thereby move the transverse rod 207 downwardly and forwardly whereby the top trailing minor flap is moved to a lower elevation than the upper back edge of the closure member 202 prior to the leading edge of the trailing flap being moved in advance of the rear part of closure 202 and is moved to a closed position. After the trailing minor flap has been advanced sufficiently to be retained in a closed, or a substantially closed position by closure member 202, the case moves out of engagement with arm 323 and the valve members 321, 322 move for applying pressure to cylinder 211 to extend its piston rod for returning the transverse rod 207 to its datum position.

After the tucker valve 316 has been actuated by the case moving into abutting engagement with arm 323, the case leading end wall moves into abutting engagement with arm 361 to actuate valve 357. Thus valve member 362 connects port 359 to port 360. It is to be mentioned that prior to this time valve 340 was operated to an on position so that fluid under pressure is being applied at ports 351, 358.

The case leading end wall moves to engage arm 370 to actuate valve 365 whereby valve member 369 fluidly connects port 366 to port 367. Further advancement of the case brings it leading end wall into engagement with arm 376 to actuate valve 371 whereby valve member 375 fluidly connects port 372 to port 373. This results in fluid under pressure being applied to ports 380, 387 to shift valve members 382, 391 so that fluid under pressure from ports 385 and 388 respectively is applied to port 384 and 390. This pressurizes the glue guns so that they extrude adhesive on the upper and lower minor leading flaps as the case is advanced.

Movement of the case into engagement with arm 355 actuates valve 350 whereby valve member 354 fluidly connects port 352 to exhaust port 353 and thus ports 380, 387 are fluidly connected to exhaust port 353. As a result valve members 382, 391 are spring urged to positions ports 383, 390 are connected to exhaust ports 384, 389 to discontinue the extrusion of adhesive by the glue heads 218, 152 prior to the leading minor flaps being moved in advance of the nozzles of the glue guns.

After its case has still further advanced, it moves out of contact with arm 361 whereby valve 357 is deactuated. At this time valve member 362 moves to connect port 358 to 359 whereby fluid under pressure is again applied to ports 380, 387 for moving valve members 382, 391 to pressurize the glue heads. The glue heads are pressurized when the trailing minor flaps are in position to have adhesive extruded thereon. Addition advancement of the case moves it out of engagement with arm 370, which deactivates valve 365. The resulting movement of valve member 369 completes a fluid connection between exhaust port 368 and ports 380, 387, and thereupon the valve members 382, 391 move to depressurized the glue heads through ports 384, 389. This discontinues the extrusion of adhesive on the trailing minor flaps.

After valve 365 has been deactuated, still further movement of the case moves it out of engagement arms 376 and 355 for deactuating valves 371 and 350 respectively. As these valves are deactuated their valve members move to connect port 372 to port 374, and port 352 to port 351.

Valves 350, 357, 365 and 371 are respectively mounted on one of members 74 and 75 in positions along the length thereof to start and stop the extrusion of adhesive so that the adhesive is applied to the flaps of the case only in areas to be adhered to other flaps of the same case.

As the case is moved in advance of the closure member 202, the leading top minor flap moves beneath the spline 223 which retains the minor flap in a closed condition. As the case is advanced beneath the spline, the top major flaps come into abutting relationship with the top closure rods 226 while the bottom major flaps come into contact with the planar plate portion **165*a*. This results in the major flaps being moved to a closed condition, the spline 223 preventing the top major flaps being moved into overlapping relationship as the top major flaps are moved to a closed condition, and the vertical plate 180 likewise preventing the bottom major flaps moving into overlapped condition as they are closed due to the upward inclination of plate portion 165*a*. The major flaps in being moved to a closed position brings them into contact with the adhesive on the minor flaps. The case in being moved in advance of closure members 165*a*, 226 is moved off the slide plate 125 and onto the rolls 191 to be supported thereby with rolls 191 abutting against the bottom major flaps. As the case is moved along rolls 191, 188** a compression force is applied by the rolls to the flaps to insure a good sealing relationship between the major and minor flaps.

What is claimed is:

1. An apparatus for applying adhesive to a filled case having a pair of bottom major flaps and leading and trailing bottom minor flaps to adhere the major flaps to the minor flaps with the major flaps underlying the minor flaps as the case is moved in a longitudinally forward direction, a longitudinally elongated frame having a front end portion and a rear end portion, a plurality of transverse flight bars, endless means for mounting the flight bars in spaced relationship and moving the flight bars therewith, said endless means having an upper run, means for mounting the endless means on the frame and driving the endless means to move the flight bars on the upper run from the frame rear portion toward the frame front position, means mounted on the frame rear portion for supporting a filled case while it is being moved forwardly by a flight bar with the major bottom flaps slightly open, slide means mounted on the frame forwardly of the means mounted on the frame rear portion for supportingly engaging the case minor bottom flaps as the case is moved forwardly, entry means for entering between the leading minor bottom flap and the slightly open major bottom flaps as the case is moved forwardly and to support the minor bottom flaps, the entry means having a front end portion and a rear entry portion, and means mounting the entry means for movement between a datum position that the entry portion is located at least in part to enter between the leading minor bottom flap and the slightly open major bottom flaps, and a lowered position, and urge the entry means to the entry portion datum position, the entry means mounting means mounting the entry means with entry portion adjacent and forwardly of the means mounted on the frame rear portion.

2. The apparatus of claim 1 further characterized in that there is provided means on the frame for limiting the degree of opening movement of the major bottom flaps as the case is moved in advance of the means mounted on the frame rear portion, and means for applying adhesive to at least one pairs of the major and minor bottom flaps at locations for adhering the minor flaps to the major flaps as the case is moved along the slide means.

3. The apparatus of claim 1 further characterized in that entry means comprises a package plate having said entry means front end portion and said entry portion, said entry portion being joined to said package plate front portion to extend rearwardly thereof at an angle relative thereto that is relatively downwardly and rearwardly inclined.

4. The apparatus of claim 3 further characterized in that the entry means mounting means includes means for mounting the entry means front portion for hinged movement about a transverse axis, and means for resiliently urging said entry means front portion to move about said axis in a generally upward direction.

5. The apparatus of claim 3 further characterized in that there is provided feed control means for controlling the forward movement of a case unto the means mounted on the frame rear portion, said feed control means including a gate that includes a transverse case blocking member, means mounting the blocking member for pivotal movement about a transverse axis and and constantly urging the blocking member to remain in a case blocking position, and power operated means for moving the blocking member mounting means to move the blocking member to a case bypassing position.

6. The apparatus of claim 5 further characterized in that the feed control means includes a feed roll, and means for mounting the feed roll longitudinally between the blocking member and the means on the frame rear portion for supporting a case to advancing engage a case bypassing the blocking means and driving the feed roll at a linear speed faster than the movement of the upper run.

7. The apparatus of claim 3 further characterized in that the mounting and driving means includes a drive shaft, means connected between the drive shaft and the first mentioned endless means for driving the first endless means, powered drive means operable between a driving condition and a stopped condition, second endless means connected between the powered drive means and the drive shaft for driving the drive shaft, and means operated by the increase of tension in the second endless means above a preselected value for stopping the powered drive means.

8. The apparatus of claim 7 further characterized in that the means operated by an increase in tension includes an elongated arm, means having a pivot axis for mounting the arm for pivotal movement, means mounted on the arm in spaced relationship to the pivot axis for engaging the second endless means, and adjustable means connected to the arm for urging the arm to move the engaging means in a direction to increase the tension in the second endless means.

9. The apparatus of claim 3 wherein the filled case has a pair of vertical top major flaps and a vertical top minor leading flap and a vertical top minor trailing flap, further characterized in that there is provided means on the frame for folding the leading minor top flap to a closed position as the case is moved over the slide means and a tucker assembly mounted on the frame for folding the trailing minor top flap to a closed position as the case is moved on the slide means, the tucker assembly including a flap folder member, means mounting the folder member for movement from a retracted position to a flap folding position as the case moves along the slide means, and piston cylinder means for moving the folder member mounting means to move the folder member between its positions.

10. The apparatus of claim 9 further characterized in that there is provided vertically elongated spline means on the frame in advance of the means for folding the top leading minor flap to retain the top minor flap in a closed condition and block overlap of the top major flaps as they are folded and means for folding the major top flaps to a closed condition overlapping the folded top minor flaps, adhesive applying means for applying adhesive to top flaps between the folding of the top major and minor flaps to adhere the folded top flaps in a closed condition upon the folding of the top major flaps, means for applying adhesive to the bottom flaps and moving the bottom flaps to adhere the bottom major flaps to the bottom minor flaps, and compression means in advance of the spline means for exerting a compressive sealing pressure to the case after the adhesive has been applied and the flaps folded.

11. Apparatus for forming sealed top and bottom closures on cases having pairs of major and minor top and bottom flaps comprising a longitudinally elongated frame having a front end portion and a rear end portion, a plurality of transverse flight bars, first endless means for mounting the flight bars in spaced relationship and moving the flight bars therewith, said first endless means having an upper run, means for mounting the first endless means on the frame and driving the first endless means to move the flight bars on the upper run forwardly from the frame rear portion towards the frame front portion, means on the frame for supporting the filled case as a flight bar moves the case forwardly and relatively moving the major and minor bottom flaps and apply adhesive to form a sealed bottom closure, and means on the frame for relatively moving the major and minor top flaps and applying adhesive to form a sealed top closure as the case is moved forwardly, the driving and mounting means including motor means operable between an on and an off condition, said motor means including a drive shaft, means for drivingly connecting the drive shaft to the first endless means and applying a driving force thereto, and means responsive to an increase in driving force in the drivingly connecting means above a preselected value for operating the motor means to its off condition, the drivingly connecting means including an endless drive member having an elongated run that is in varying tension as the drive force for driving the first endless means varies, and the means responsive to the drive force including means operated by the increase of tension in the elongated run above a preselected value for stopping the motor means, the means operated by an increase in tension including an elongated arm, means having a pivot axis for mounting the arm for pivotal movement, means mounted on the arm in spaced relationship to the pivot axis for engaging the elongated run and adjustable means connected to the arm for urging the arm to move the engaging means in a direction to increase the tension in the elongated run.

12. Apparatus for forming sealed top and bottom closures on cases having pairs of major and minor top and bottom flaps comprising a longitudinally elongated frame having a front end portion and a rear end portion, a plurality of transverse flight bars, endless means for mouting the flight bars in spaced relationship and moving the flight bars therewith, said endless means having an upper run, means for mounting the endless means on the frame and driving the endless means to move the flight bars on the upper run forwardly from the frame rear portion towards the frame front portion, means on the frame for supporting the filled case as a flight bar moves the case forwardly and relatively moving the major and minor bottom flaps and apply adhesive to form a sealed bottom closure, and means on the frame for relatively moving the major and minor top flaps and applying adhesive to form a sealed top closure as the case is moved forwardly, the driving means including a motor operable between an on and an off condition, means for drivingly connecting the motor to the endless means and applying a driving force thereto, and means responsive to an increase in driving force in the drivingly connecting means above a preselected value for operating the motor to its off condition, and indexing means on the frame rear portion for controling the movement of a filled case onto the means for supporting a filled case, the indexing means including a stop member rearwardly of the upper run, and means actuated by the movement of a flight bar for moving the stop member from a case blocking position to a case bypass position.

13. The apparatus of claim 12 further characterized in that the means for supporting a case includes a feed roll on the frame rear portion forwardly of the stop member for frictionally engaging a case to move the engaged case and means driven by the means for driving the endless means for drivingly rotating the roll at a peripheral linear speed that is greater than speed of linear movement of a flight bar carried by the upper runs and that the means actuated by the movement of a flight bar includes operable means mounting the stop member on the frame for movement between on elevated blocking position and a lowered bypass position, and a piston cylinder combination on the frame for operating the means mounting the stop member to move the stop member from its blocking position to its bypass position.

14. Apparatus for forming sealed top and bottom closures in cases having transverse opposite sidewalls, a leading sidewall, a trailing side wall and pairs of major and minor top and bottom flaps with the bottom minor flaps being in overlaying relationship to the bottom major flaps and the bottom minor flaps joined to the leading and trailing side walls, comprising a longitudinally elongated frame having a front end portion and a rear end portion, a plurality of transverse flight bars, endless means for mounting the flight bars in spaced relationship and moving the flight bars therewith, said endless means having an upper run, means for mounting the endless means on the frame and driving the endless means to move the flight bars on the upper run forwardly from the frame rear portion toward the frame front portion, means on the frame for supporting the filled case as a flight bar moves the case forwardly and relatively moving the major and minor bottom flaps and apply adhesive to form a sealed bottom closure, means on the frame for moving the major and minor top flaps and applying adhesive to form a sealed top closure as the case is moved forwardly, indexing means mounted on the frame rear portion for controlling the timing of the movement of a case onto the means for supporting a case, the indexing means including a stop member rearwardly of the upper run, and means for mounting the stop member on the frame and moving the stop member between an elevated case blocking position to block the movement of a case onto the means for supporting a filled case and a lowered case bypass position and a driven feed roll mounted on the frame between the stop member and the means for supporting a case for engaging case bottom flaps to move a case forwardly at a higher rate of speed than that of the forward movement of a flight bar along the upper run, the means for supporting a case including a first plurality of longitudinally spaced frusto conical rolls, a second plurality of frusto conical rolls; each of the frusto conical rolls having a major base and a minor base, means for mounting the frusto conical rolls for rotation about transverse axes with the first frusto conical rolls transversely spaced from the second frusto conical rolls and the first frusto conical rolls minor bases more closely adjacent the second frusto conical rolls minor bases than the second frusto conical rolls major bases, the drive roll being mounted on the frame longitudinally between the stop member and the frusto conical rolls for moving a case bypassing the stop member onto the frusto conical rolls.

15. The apparatus of claim 14 further characterized in that the means for supporting a filled case includes longitudinally elongated slide means in advance of the frusto conical rolls for supporting the case minor flaps and case contents as the case is moved forwardly, a package plate having a generally planar front end portion and a rear nose portion extending downwardly and rearwardly of the plate front end portion, the nose portion have a rear apex part, and means for mounting the package plate on the slide means to extend rearwardly thereof and forwardly of and closely adjacent the frusto conical rolls and resiliently retain the package plate in a datum position that the apex part is at a lower elevation than the leading side wall of a case supported by the frusto conical rolls and at an elevation to enter between the case leading side wall and the bottom major flaps.

16. The apparatus of claim 15 further characterized in that slide means includes a generally planar, longitudinally elongated slide plate, that the package plate forward portion in the package plate datum position extends upwardly and rearwardly of the slide plate, that the means for mounting the package plate includes means for limiting the movement of the package plate to a position that the package plate front portion extends substantially coplanar with the slide plate, and that the means for mounting and moving the stop member includes a longitudinally elongated bar having a first end portion joined to the stop member, an intermediate portion and a second end portion, transverse pivot means for pivotally mounting the intermediate portion on the frame, means acting on the bar second end portion to constantly urge it downwardly, and piston cylinder means on the frame for moving the bar to pivot in a direction for moving the stop member downwardly.

17. An apparatus for applying adhesive to a filled case having a pair of bottom major flaps and leading and trailing bottom minor flaps to adhere the major flaps to the minor flaps with the major flaps underlying the minor flaps as the case is moved in a longitudinally forward direction, a longitudinally elongated frame having a front end portion and a rear end portion, a plurality of transverse flight bars, endless means for mounting the flight bars in spaced relationship and moving the flight bars therewith, said endless means having an upper run, means for mounting the endless means on the frame and driving the endless means to move the flight bars on the upper run from the frame rear portion toward the frame front position, means mounted on the frame rear portion for supporting a filled case while it is being moved forwardly by a flight bar with the major bottom flaps slightly open, slide means mounted on the frame forwardly of the means mounted on the frame rear portion for supportingly engaging the case minor bottom flaps as the case is moved forwardly, entry means mounted on the frame between the slide means and the means mounted on the rear of the frame for entering between the leading minor bottom flap and the slightly open major bottom flaps as the case is moved forwardly and to support the minor bottom flaps, indexing means on the frame rear portion for controlling the movement of a filled case onto the means for supporting a filled case, the indexing means including a stop member rearwardly of the upper run, and means actuated by the movement of a flight bar for moving the stop member from a case blocking position to a case bypass position.

18. The apparatus of claim 17 further characterized in that the means mounted on the frame rear portion includes a feed roll on the frame rear portion forwardly of the stop member for frictionally engaging a case to move the engaged case, means driven by the means for driving the endless means for drivingly rotating the roll at a peripheral linear speed that is greater than speed of linear movement of a flight bar carried by the upper run and frusto conical roller means mounted on the frame between the roll and entry means for supporting the filled case as it moves off the roll with the major bottom flaps slightly open.

* * * * *